US008327605B1

(12) United States Patent
Binder

(10) Patent No.: US 8,327,605 B1
(45) Date of Patent: Dec. 11, 2012

(54) ROOF BATTEN SYSTEM

(75) Inventor: Steven Binder, Phoenix, AZ (US)

(73) Assignee: Binder Revocable Trust, Phoenix, AZ (US)

( * ) Notice: Subject to any disclaimer, the term of this patent is extended or adjusted under 35 U.S.C. 154(b) by 441 days.

(21) Appl. No.: 12/642,318

(22) Filed: Dec. 18, 2009

Related U.S. Application Data

(63) Continuation-in-part of application No. 12/182,005, filed on Jul. 29, 2008, now Pat. No. 8,033,073.

(51) Int. Cl.
*E04B 1/00* (2006.01)
*E04G 21/00* (2006.01)
*E04G 23/00* (2006.01)

(52) U.S. Cl. ..... 52/746.11; 52/553; 52/550; 52/302.3; 52/478; 52/309.9; 52/309.15

(58) Field of Classification Search ..... 52/553, 52/552, 558, 408, 409, 302.4, 302.3, 309.14, 52/309.15, 302.1, 309.8, 309.9, 410, 746.11; 264/46.5
See application file for complete search history.

(56) References Cited

U.S. PATENT DOCUMENTS 4,372,901 A * 2/1983 Kim ..... 264/46.5
4,445,306 A * 5/1984 Schauffele ..... 52/410
4,718,211 A * 1/1988 Russell et al. ..... 52/409
4,747,247 A * 5/1988 Petersen et al. ..... 52/408
5,471,807 A * 12/1995 Vasquez ..... 52/553
5,540,022 A * 7/1996 Morris ..... 52/309.8
5,815,989 A * 10/1998 Bennenk et al. ..... 52/80.1
5,842,315 A * 12/1998 Lin ..... 52/309.9
5,918,644 A * 7/1999 Haack et al. ..... 138/151
RE39,825 E * 9/2007 Morris et al. ..... 52/553
8,033,073 B1 * 10/2011 Binder ..... 52/553
2003/0172606 A1 * 9/2003 Anderson ..... 52/302.1

* cited by examiner

*Primary Examiner* — William Gilbert
*Assistant Examiner* — Chi Q Nguyen
(74) *Attorney, Agent, or Firm* — Parsons & Goltry; Robert A. Parsons; Michael W. Goltry

(57) ABSTRACT

A method of the production of a composite roof batten includes forming a substantially rigid low-density lower reinforcing element with cup-shaped depressions defining moisture-passing channels therebetween and providing an upper reinforcing element. The cup-shaped depressions of the lower reinforcing element have introduced therein a low density closed cell foam material and the upper reinforcing element is positioned in overlying relationship to the lower reinforcing element. The foam material is allowed to fill the space defined between the lower reinforcing element and the upper reinforcing element and bond the elements together to form a composite roof batten.

17 Claims, 5 Drawing Sheets

ROOF BATTEN SYSTEM

CROSS-REFERENCE TO RELATED APPLICATION

This application is a Continuation-in-Part of U.S. patent application Ser. No. 12/182,005, filed 29 Jul. 2008 now issued as U.S. Pat. No. 8,033,073.

FIELD OF THE INVENTION

This invention relates to roof batten systems.

More particularly, the present invention relates to battens used especially in the installation of clay or concrete tile roof assemblies and methods of production.

BACKGROUND OF THE INVENTION

Typically, clay or concrete tile roof systems are installed over roofing substrates using supportive roof battens. Roof battens are conventionally supplied as nominal 1"×2" wooden strips. Such battens are customarily secured to a sloping roof in a series of horizontal lines. Customarily, battens are secured by nailing, screwing, or stapling.

The use of such traditional roof battens had been shown to produce a number of post-installation problems. Foremost among these is the tendency of such battens to collect water and debris on the underlying roof surface and to inhibit air circulation under the roof tiles. When water and debris migrate through the tile and collect behind the battens, they will often degrade the protective paper or felt underlayment if the water is allowed to remain for any extended duration. This detrimental condition eventually breaks down the underlayment, allowing water to seep to the underlying roof structure, typically leading to further roof deterioration and the potential for damage within the building structure. Inhibiting air circulation under the tiles further contributes to retention of moisture, and allows greater heat build-up adversely impacting temperature control of the structure interior spaces.

The traditional use of wood as a batten material has been, historically, a popular choice due to its inherent low cost. Unfortunately, wood is susceptible to rot, insect damage, and readily retains moisture. Clearly, a durable, low cost, batten system that addresses the above-described problems would be of great benefit to many.

It would be highly advantageous, therefore, to remedy the foregoing and other deficiencies inherent in the prior art.

An object of the present invention is to provide improved methods of fabrication of synthetic battens.

Another object of the present invention is to provide a system of improved synthetic battens for use especially in clay or concrete tile roof systems.

It is another object of the present invention to provide a batten system which permits fluid and air flow.

A further primary object of the present invention is to provide a batten system that is efficient, inexpensive, and handy. Other objects and features of this invention will become apparent with reference to the following descriptions.

SUMMARY OF THE INVENTION

Briefly, to achieve the desired objects and advantages of the instant invention provided is a method related to the production of at least one composite roof batten. The method includes the steps of forming a substantially rigid low-density lower reinforcing element including contoured surface shapes corresponding to moisture-passing channels and providing an upper reinforcing element. The method further includes introducing into the lower reinforcing element a low density closed cell foam material, placing the upper reinforcing element in overlying relationship to the lower reinforcing element, and allowing the foam material to fill the space defined between the lower reinforcing element and the upper reinforcing element to form a composite roof batten.

In a specific embodiment, the instant invention provides a method related to the production of at least one composite roof batten including the steps of forming a lower reinforcing sheet of substantially rigid low-density material including a plurality of lower reinforcing elements, each element including contoured surface shapes corresponding to moisture-passing channels. The sheet forming can be accomplished by steps such as thermo-forming a sheet or molding the substantially rigid low-density material into a sheet of lower reinforcing elements. The lower reinforcing sheet is cut into individual lower reinforcing elements and a plurality of upper reinforcing elements are provided. Each lower reinforcing element has introduced therein a low density closed cell foam material and one upper reinforcing element is positioned in overlying relationship to each individual lower reinforcing element. The foam material is allowed to fill the space defined between each individual lower reinforcing element and the overlying upper reinforcing element to form a plurality of composite roof battens.

The instant invention further provides a composite roof batten structured and arranged to support roof tiles over a roof structure including a lower reinforcing element including contoured surface shapes corresponding to moisture-passing channels. A substantially rigid low-density core (such as low density closed cell foam material) is positioned on the lower reinforcing element, the core being structured and arranged to reinforce the lower reinforcing element. An upper reinforcing element is positioned in overlying relationship to the lower reinforcing element with the substantially rigid low-density core therebetween. The upper reinforcing element is structured and arranged to reinforce the substantially rigid low-density core. The upper reinforcing element and the lower reinforcing element are firmly attached to the substantially rigid low-density core.

DETAILED DESCRIPTION OF THE PREFERRED EMBODIMENT

Figure 1:
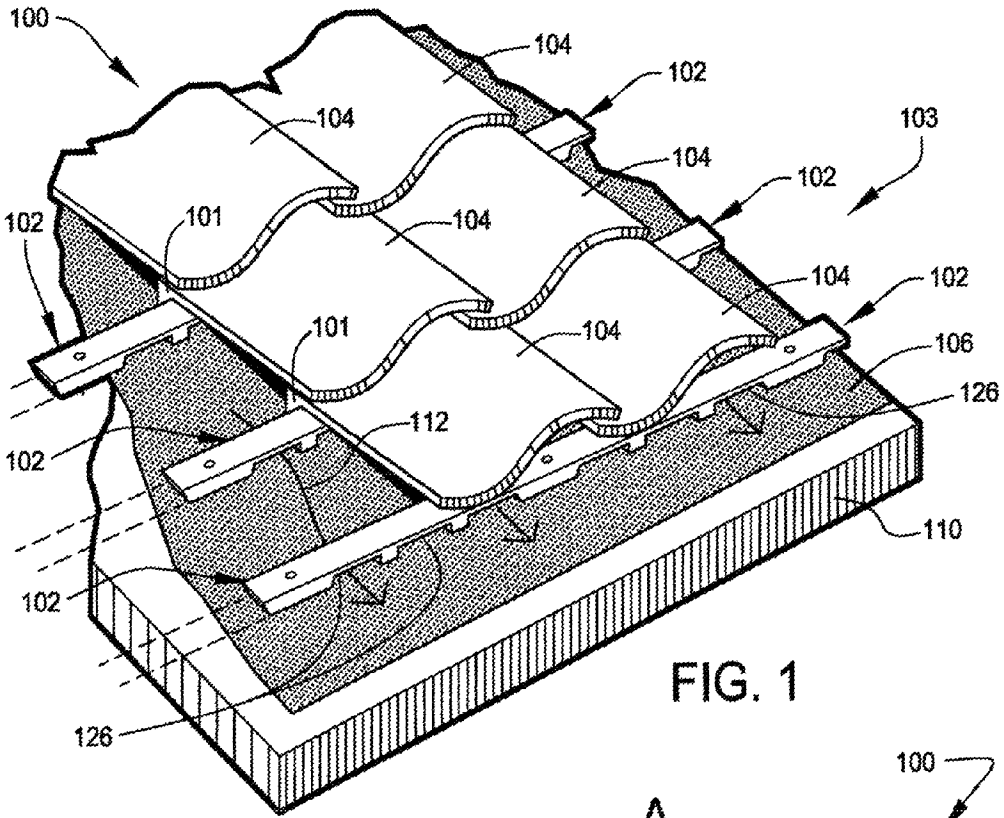
FIG. 1 shows a partial cut-away perspective view, illustrating an installation of a composite roof batten integrated within a roof assembly, according to the present invention.

FIG. 1 shows a cut-away perspective view illustrating an installation of a composite roof batten 102 according to a preferred embodiment of the present invention. Composite roof batten 102 is a preferred embodiment within a roof batten system 100. Composite roof batten 102 is utilized to install roofing tiles 104 of a type having a lip or lug 101 that is engaged over composite roof batten 102, as shown. The preferred structures and arrangements of composite roof batten 102 are designed to provide a batten construction that is substantially resistant to rot and insect damage. Furthermore, the preferred structures and arrangements of composite roof batten 102 are designed to readily shed moisture and permit airflow under roofing tiles 104, as described below.

Figure 3:
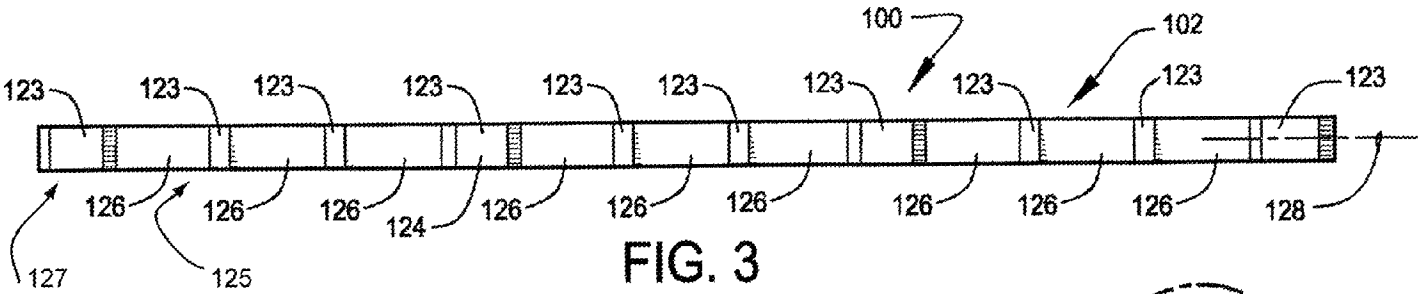
FIG. 3 shows a bottom view, illustrating the composite roof batten FIG. 1.
Figure 4:
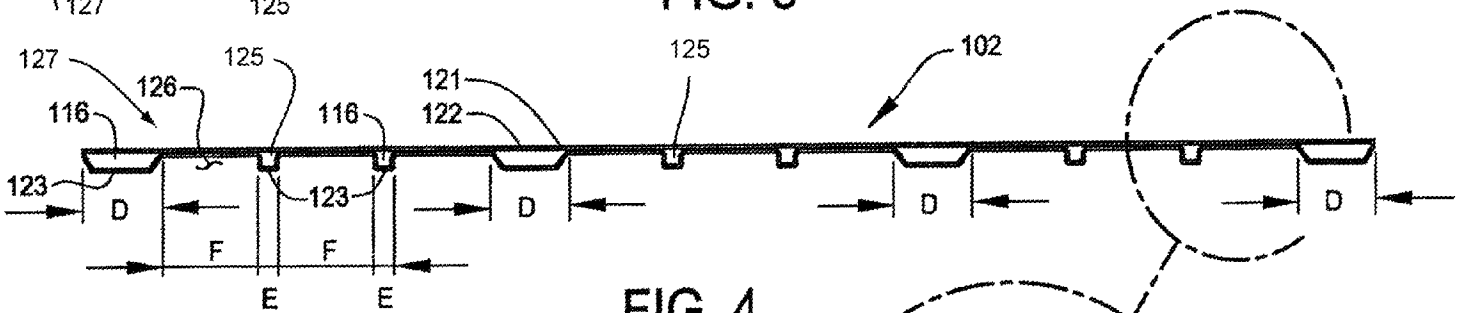
FIG. 4 shows a sectional side view, of the composite roof batten of FIG. 1.
Figure 4:
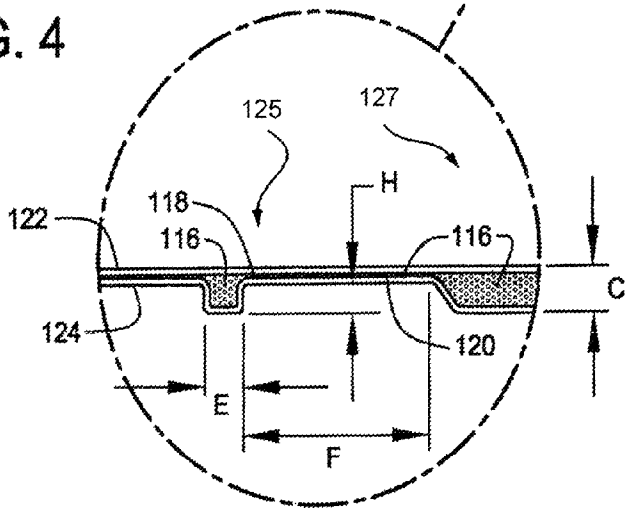
Figure 5:
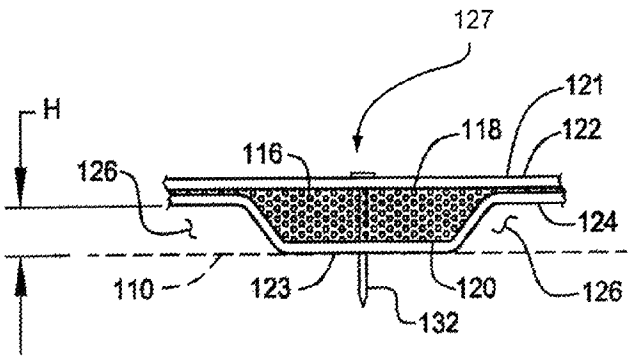
FIG. 5 shows a partial sectional side view, of the composite roof batten of FIG. 1 with a securing fastener.

Referring to FIGS. 3, 4, and 5, it can be seen that composite roof batten 102 has an elongated bar-like shape, made up of a partial encapsulation of a lightweight but rigid inner core 116 within two relatively "tough" outer cover layers or elements 122 and 124 and includes at least one transverse passage/channel to facilitate the movement of moisture and air 112 through battens 102. Composite roof batten 102 is placed over a flexible water-resistant underlayment 106 in an orientation substantially perpendicular to the direction of the slope of roof system 103 and mechanically fastened to roof substrate 110, as shown.

Core 116 includes a substantially rigid low-density material having an upper boundary 118, and lower boundary 120. Upper reinforcing layer or element 122 is structurally bonded to upper boundary 118 of core 116 and lower reinforcing layer or element 124 is structurally bonded to lower boundary 120 of core 116. Lower reinforcing layer or element 124 is structured and arranged to reinforce the composite structure and upper reinforcing layer or element 122 is structured and arranged to reinforce the composite structure.

When composite roof batten 102 is installed as illustrated in FIG. 1, and subjected to normal "in-service" loading, upper reinforcing layer or element 122 typically supports compression loading while lower reinforcing layer or element 124 typically supports tension loading. Core 116 functions to maintain upper reinforcing layer or element 122 and lower reinforcing layer or element 124 in relative position to each other (primarily resisting shear forces within the core region), thus reducing the tendency of the overall batten structure to buckle and deflect under load.

The stiffness of composite roof batten 102 is significantly controlled by the thickness and material properties of the selected core material. The substantially rigid low-density material of core 116 preferably includes expanded foam material and can be a rigid cellular foam such as a foamed Polyurethane material. Compression strength, shear strength, tension strength, flexural strength, stiffness, creep behavior, and other mechanical properties of core 116 depend significantly on the density of the selected material. Thus, depending on the intended application, preferred embodiments of composite roof batten 102 utilize material densities ranging from about ¾ pound per cubic foot to about three pounds per cubic foot.

Upper reinforcing layer or element 122 and lower reinforcing layer or element 124 are firmly adhered to core 116, for example by using a bonding compound, such as a thermoplastic adhesive (hot-melt adhesive), heating of the core and layers, or a natural adhesion between the foamed core and the upper and lower reinforcing layers. Thus, the above-described bonded assembly produces a relatively lightweight, high-strength composite support structure 130 (illustrated in FIG. 10). Upon reading the teachings of this specification, those of ordinary skill in the art will now understand that, under appropriate circumstances, considering such issues as intended use, cost, advances in adhesive technology, etc., other bonding arrangements, such as reactive adhesives, contact adhesives, etc., may suffice.

Upper reinforcing layer or element 122 includes a substantially continuous upper contact surface 121 that functions to supportively contact the bottom surface of roofing tile 104. Lower reinforcing layer or element 124 includes a plurality of thinner cup-shaped ribbed-depressions 125 having lower contact surfaces 123, as shown. Lower reinforcing layer or element 124 also includes a plurality of wider cup-shaped attaching-depressions 127 having lower contact surfaces 123, as shown. Each lower contact surface 123 is structured and arranged to rest on underlayment 106 of roof system 103, as best shown in FIG. 1.

Composite roof batten 102 includes a plurality of transverse channels 126, defined between adjacent ribbed-depressions 125 and/or attaching-depressions 127, and structured and arranged to assist the passage of moisture and air through each composite roof batten, as shown. Channels 126 include a plurality of spaced openings spanning between adjacent sets of lower contact surfaces 123, spaced essentially evenly along longitudinal axis 128, as shown. Each channel 126 is structured and arranged to assist the passage of moisture and air 112 through composite roof batten 102, also illustrated in FIG. 1.

In this specific embodiment, composite roof batten 102 has a length A of about 48 inches and a width B of about 1½ inches with a finished thickness C of about ¾ inch. Upon reading the teachings of this specification, those of ordinary skill in the art will now understand that, under appropriate circumstances, considering such issues as intended use, etc., other thickness arrangements, such as producing a composite assembly having thicknesses up to about three inches, to provide additional air movement under the roof tile, etc., may suffice. Each channel 126 has a width F of between about one inch and about three inches and an open height H of about ½ inch.

Within the preferred length A, a composite roof batten 102 includes, as an example, ten lower contact surfaces 123 and nine channels 126, as shown. Four of the ten lower contact surfaces 123 preferably have a length D of about three inches and six of the ten lower contact surfaces 123 have a length E of about ¾ inches (see enlarged sectional view of FIG. 4). Further, in this specific example, six of the ten lower contact surfaces 123 are equally spaced (at about the quarter points) along the length. The six smaller contact surfaces 123 are interspersed between adjacent sets of larger contact surfaces 123 such that the maximum span of the spaced openings (between any two contact points) is no less than about one inch and no greater than about four inches. In this specific example, the maximum clear span between any two adjacent contact points includes a distance F of about 3½ inches.

Upper reinforcing layer or element 122 and lower reinforcing layer or element 124 are each formed of rigid thermoplastic, such as Acrylonitrile-Butadine-Styrene (ABS) material. Upper reinforcing layer or element 122 and lower reinforcing layer or element 124 each have an initial sheet thickness of between about 0.06 inches and 0.3 inches and may have similar or different thicknesses.

FIG. 5 shows a partial sectional side view of composite roof batten 102 firmly secured to underlayment 106 using a fastener 132 extending through one attaching-depression 127, according to the embodiment of FIG. 1. Each composite roof batten 102 is firmly secured to roof substrate 110 using at least four fasteners 132 through four attaching-depressions 127. Each of the four fasteners 132 is approximately centered within one of the four larger attaching-depressions 127, as shown. Fasteners 132 include a mechanical-type fastener, such as nails, screws, etc. The preferred structures and arrangements of composite roof batten 102, as described herein, comprise sufficiently mechanical strength to allow for pneumatic nailing or power-driven screwing using industry-standard tools known in the art.

Figure 6:
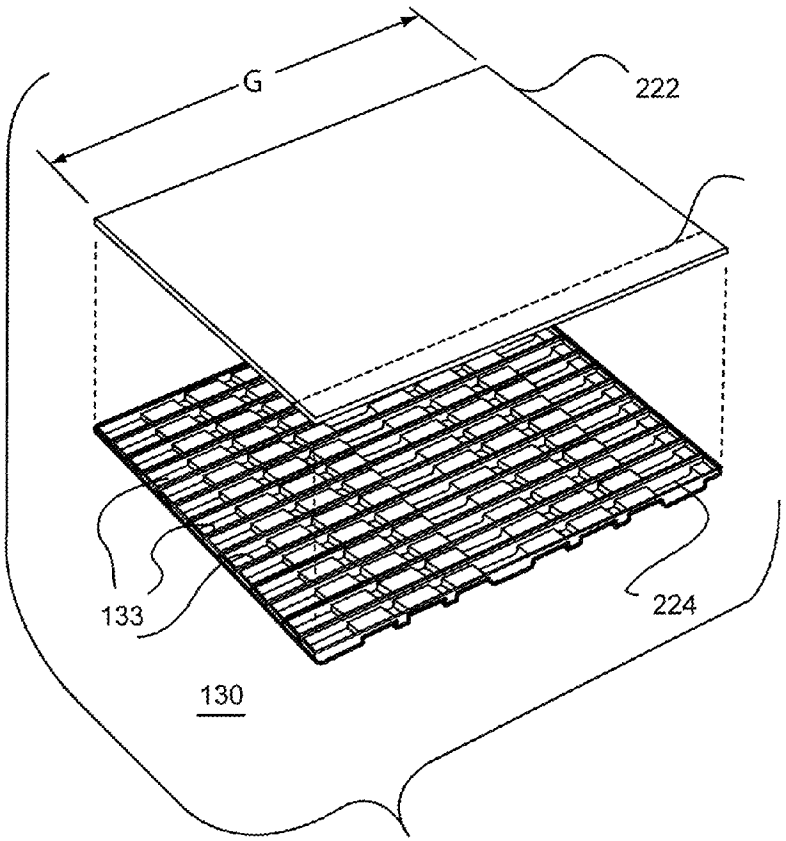
FIG. 6 shows an exploded perspective view, of a composite sheet used to produce a plurality of the composite roof battens, according to one embodiment of the present invention.

FIG. 6 shows an exploded perspective view of a method used to produce an uncut composite sheet 130 incorporating a plurality of composite roof battens 102, according to one embodiment of the present invention. Composite sheet 130 includes upper reinforcing sheet 222 and lower reinforcing sheet 224, as shown. Each uncut sheet of the depicted composite includes a generally square outer dimension G, in accordance with the above described example, of about 48 inches. Prior to assembly, upper reinforcing sheet 222 has a generally smooth and planar conformation and lower reinforcing layer 224 is pre-formed to comprise the plurality of contoured surface shapes defining each lower reinforcing layer or element 124, described above and shown in FIG. 7.

Figure 7:
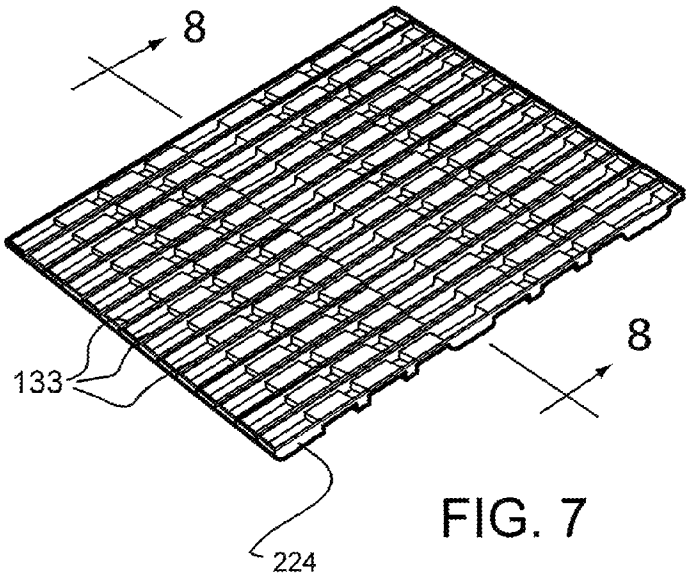
FIG. 7 shows a perspective view of the lower reinforcing sheet of FIG. 6.
Figure 8:
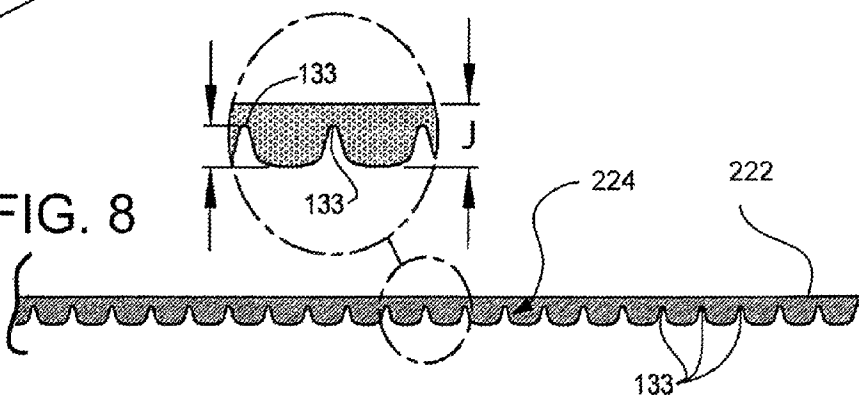
FIG. 8 shows a sectional view, through section 8-8 of FIG. 7.

FIG. 7 shows a perspective view of the uncut lower reinforcing sheet 224 of FIG. 6. FIG. 8 shows a sectional view, through section 8-8 of FIG. 7. The uncut lower reinforcing sheet 224 is pre-formed, for example by thermo-transforming, to comprise contoured surface shapes corresponding to the cup-shaped ribbed-depressions 125 and the cup-shaped attaching-depressions 127 defining the moisture-passing channels 126 depicted in FIG. 4, or by molding the sheet directly with the desired contoured surfaces.

Lower reinforcing sheet 224 is formed to define a plurality of reinforcing layers or elements 124 arranged in this specific example into 32 essentially identical parallel rows. Each individual reinforcing layer or element 124 of the uncut lower reinforcing sheet 224 is defined by a plurality of parallel channels 133. Channels 133 indicate the preferred location of cuts, which will eventually divide the assembled composite sheet 130 into individual reinforcing layers or elements 124 or into composite roof battens 102. Each channel 133, for example, has a depth K of about 9/16 inch. Further, it should be noted, the combination of the contoured surface shapes corresponding to the moisture-passing channels 126 and the channels 133 results in the generally cup-shaped depressions or formations 125 and 127

Figure 9:
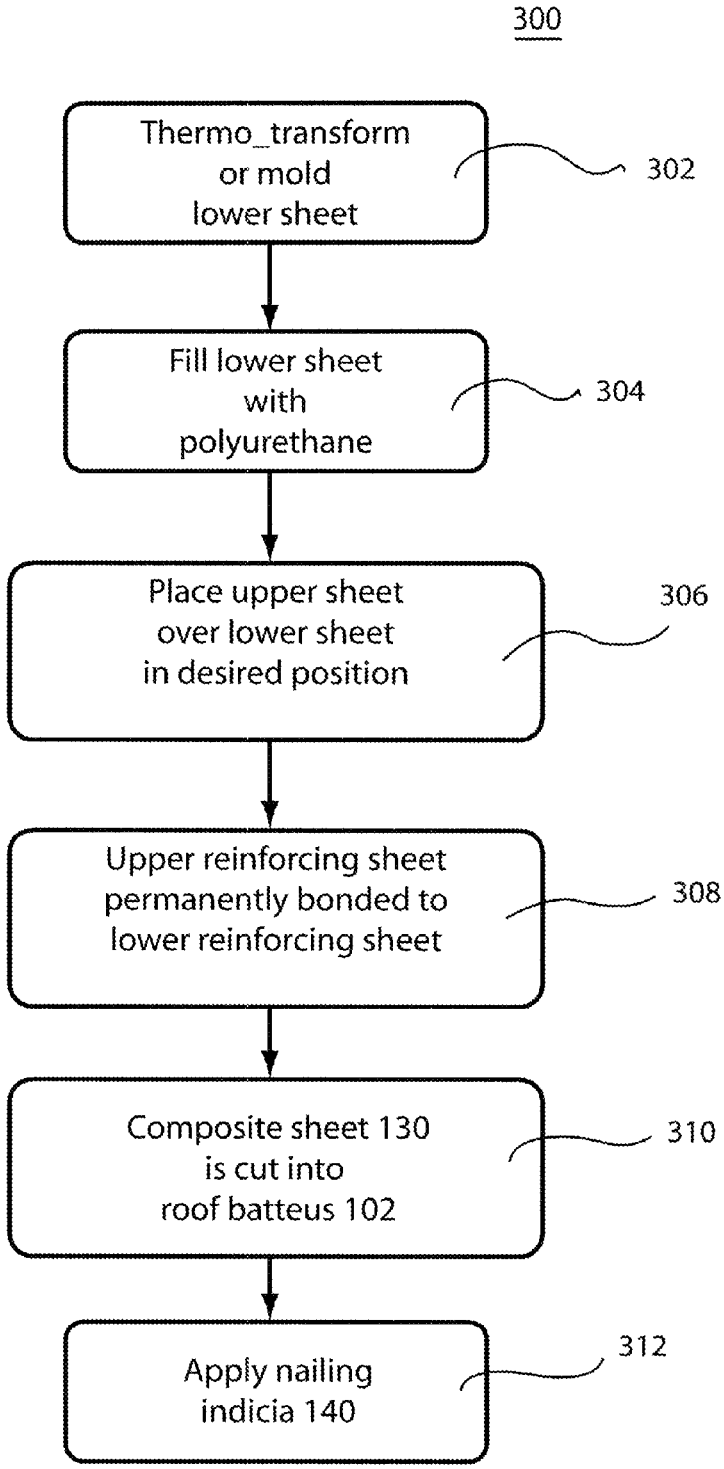
FIG. 9 shows a diagram illustrating the steps of a method enabling the fabrication of a composite sheet producing a plurality of the composite roof battens in accordance with the present invention.

Preferably, the entire upper reinforcing sheet 222 and lower reinforcing sheet 224 are firmly adhered together by a low-density core injected therebetween, as described in conjunction with FIG. 9. In this embodiment, composite sheet 130 is formed as a single unit and is then cut into the above-described individual composite roof battens 102.

FIG. 9 is a simplified flow diagram illustrating the steps of a method 300 enabling the fabrication of composite sheet 130 and a plurality of composite roof battens 102, according to one method of the present invention. Method 300 includes the following fabrication steps.

The fabrication of a composite sheet 130 begins with one sheet of substantially rigid low-density ABS plastic material as indicated in step 302, which forms lower reinforcing sheet 224. Lower reinforcing sheet 224 is then thermo-transformed into the shape illustrated in FIG. 7. Alternatively, plastic material is molded initially into a sheet that includes the shape illustrated in FIG. 7. In step 302, it should be understood that lower reinforcing sheet 224 is sufficiently thick to retain the desired form throughout the remainder of the process. In step 304, a foaming agent is introduced into cup-shaped depressions 125 and 127 in lower reinforcing sheet 224 by means of one or more dispensing heads (not shown). The foaming agent will generally be a liquid material including, for example, two parts polyurethane, for producing a low density closed cell foam. In step 306, upper reinforcing sheet 222 is placed in overlying relationship to lower reinforcing sheet 224 and generally spaced from lower reinforcing sheet 224 a desired distance. In this process the term "spaced from" includes any desired spacing down to and including abutting. The foaming agent between upper and lower reinforcing sheets 222 and 224 will continue until the entire cavity is filled. In some instances it may be useful to provide vent holes in upper and/or lower reinforcing sheets adjacent the ends to vent air and any excess foam that may occur.

A bonding agent may be applied to the inner surface of either or both upper and lower reinforcing sheets 222 and 224, generally prior to the foaming step, if determined desirable. The bonding agent may be strictly an adhesive material or may be heat or pressure activated material, that is activated subsequent to or in conjunction with the foaming step, e.g. contact cement, thermal (hot-melt) glue, etc. In some instances, the foam generated by the foaming agent may be sufficiently adhesive to bond the upper and lower reinforcing sheets together without the need for an additional bonding agent.

Figure 10:
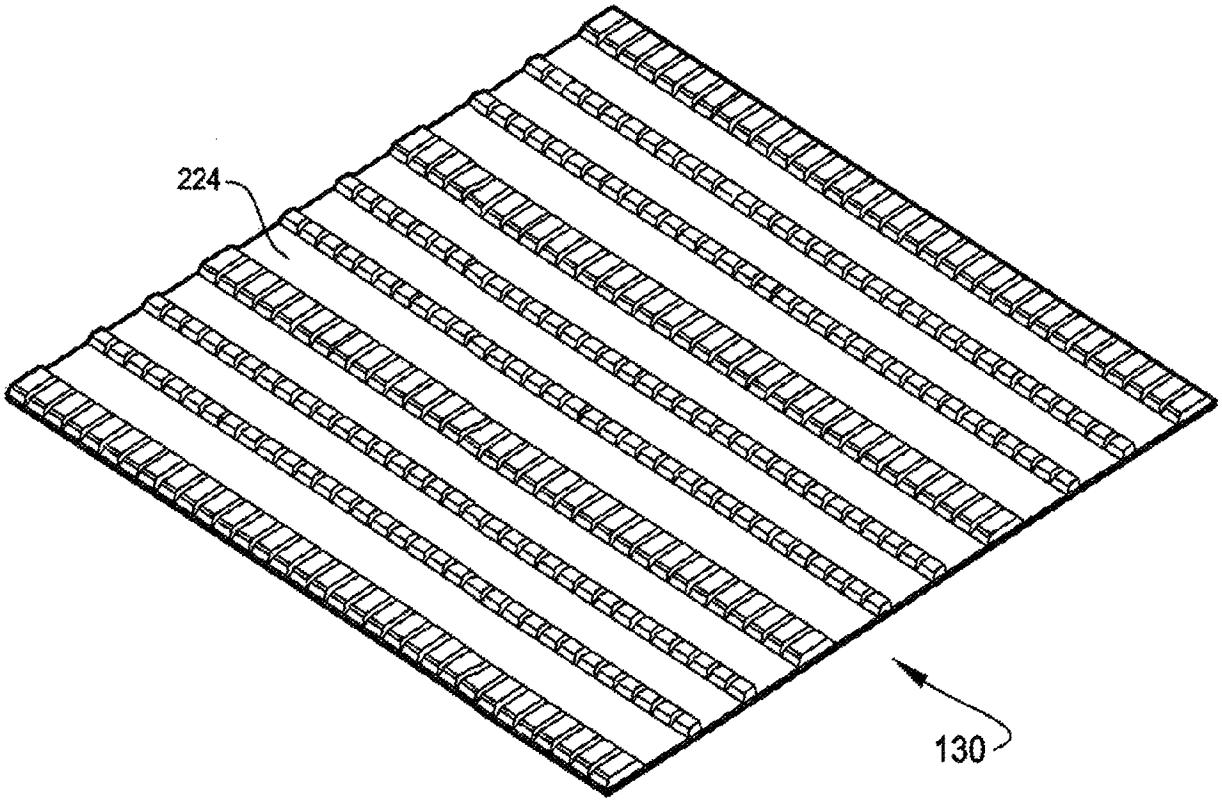
FIG. 10 shows a perspective view of the assembled composite of FIG. 6.

Referring additionally to FIG. 10, a perspective view is illustrated of the assembled composite sheet 130 of FIG. 6. With the foaming agent hardened into the desired low density closed cell foam and the bonding agent, if included, sufficiently hardened to form composite sheet 130, composite sheet 130 is cut into strips producing the plurality of essentially identical composite roof battens 102, as indicated in preferred step 310.

In an alternate embodiment, the lower reinforcing sheet 224 is formed to define a plurality of individual batten lower reinforcing elements 124 arranged in this specific example into a plurality of essentially identical parallel rows, as described above. Each individual roof batten reinforcing element 124 of the uncut lower reinforcing sheet 224 is further defined by a plurality of parallel channels 133. Sheet 224 is then separated into individual batten lower reinforcing elements 124 by some convenient method, such as a die cutter or the like. In some applications it may be convenient to simply mold individual batten lower reinforcing elements 124 directly, rather molding and cutting an entire sheet. In either process, upper reinforcing sheet 222 is precut into individual batten upper reinforcing elements 122.

The individual batten lower reinforcing elements 124 are then indexed into a conveyor machine that includes a dispensing head that introduces into the cup-shaped depressions 125 and 127 a liquid foaming material as the element passes on the conveyor. An individual batten upper reinforcing element 122 is then positioned over each individual batten lower reinforcing element 124 and the liquid foaming material is allowed to fill any area between the individual lower element 124 and the individual upper element 122. It may be desirable to provide vent holes in one of the upper and lower elements to allow air and any excess foaming material to escape as the foaming process continues.

Figure 2:
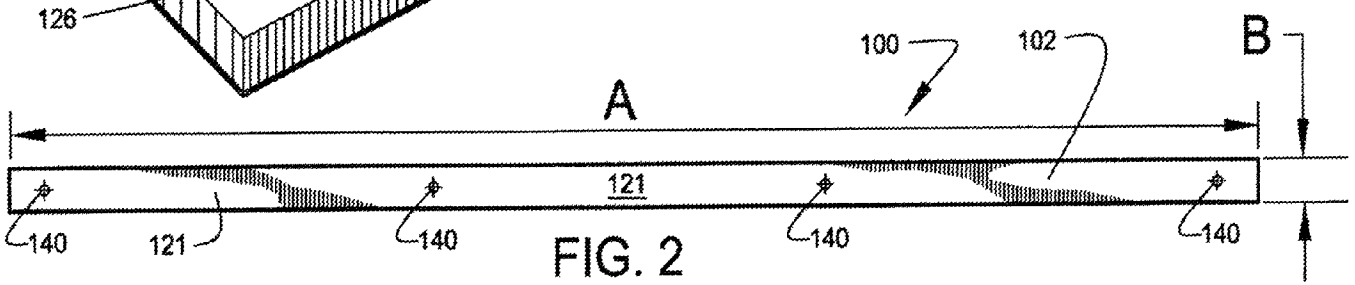
FIG. 2 shows a top view, illustrating the composite roof batten of FIG. 1.

In an optional step 312, nailing indicia 140 (preferably comprising a printed surface marking structured and arranged to assist a user in properly locating at least one mechanical fastener used to fasten composite roof batten 102 to the roof structure) is applied to outer surface of upper reinforcing element 122, as best shown in FIG. 2.

It will be understood that the broadest scope of this invention includes modifications such as diverse shapes, sizes, and materials. Further, while specific shapes, dimensions, and spacing have been illustrated for the various cup-shaped depressions, it will be understood that these can vary substantially depending upon the application. Accordingly, the scope is limited only by the below claims as read in connection with the above specification. Further, many other advantages of the invention will be apparent to those skilled in the art from the above descriptions and the below claims.

What is claimed is:

1. A method related to the production of at least one composite roof batten, said method comprising the steps of:

forming a substantially rigid low-density lower reinforcing element including contoured surface shapes defining moisture-passing channels by one of thermo-forming and molding the lower reinforcing element;

providing an upper reinforcing element;

introducing a low density closed cell foam material into the lower reinforcing element; and placing the upper reinforcing element in overlying relationship to the lower reinforcing element and allowing the foam material to fill a space defined between the lower reinforcing element and the upper reinforcing element to form a composite roof batten.

2. The method according to claim 1 wherein the step of forming a substantially rigid low-density lower reinforcing element includes forming the substantially rigid low-density lower reinforcing element of acrylonitrile-butadine-styrene material.

3. The method according to claim 1 wherein the step of providing an upper reinforcing element includes providing the upper reinforcing element of acrylonitrile-butadine-styrene material.

4. The method according to claim 1 wherein the step of introducing includes introducing into the lower reinforcing element a foaming solution including polyurethane.

5. The method according to claim 1 wherein the step of forming includes forming a substantially rigid low-density lower reinforcing sheet including a plurality of lower reinforcing elements, each element including contoured surface shapes defining moisture-passing channels.

6. The method according to claim 5 wherein the step of forming further includes a step of cutting the lower reinforcing sheet into the plurality of lower reinforcing elements, each element including contoured surface shapes defining moisture-passing channels.

7. The method according to claim 5 wherein the step of providing an upper reinforcing element further includes a step of providing an upper reinforcing sheet including a plurality of upper reinforcing elements and the step of placing the upper reinforcing element in overlying relationship to the lower reinforcing element includes placing the upper reinforcing sheet in overlying relationship to the lower reinforcing sheet to form a composite sheet, the method further including a step of cutting the composite sheet into strips so as to produce a plurality of essentially identical composite roof battens.

8. A method related to the production of at least one composite roof batten, said method comprising the steps of:

forming a substantially rigid low-density lower reinforcing element including contoured surface shapes defining moisture-passing channels by one of thermo-forming and molding the lower reinforcing element;

providing an upper reinforcing element;

introducing a low density closed cell foam material into the lower reinforcing element;

placing the upper reinforcing element in overlying relationship to the lower reinforcing element and allowing the foam material to fill a space defined between the lower reinforcing element and the upper reinforcing element to form a composite roof batten; and bonding the lower reinforcing element with the low density closed cell foam material and the low density closed cell foam material with the upper reinforcing element subsequent to the step of placing the upper reinforcing element.

9. The method according to claim 8 wherein the step of introducing includes introducing into the lower reinforcing element a foaming solution that bonds with the lower and upper reinforcing elements.

10. The method according to claim 8 further including a step of applying a bonding agent to at least one of an inner surface of the lower reinforcing element prior to the introducing step and an inner surface of the upper reinforcing element prior to the placing step.

11. A method related to the production of at least one composite roof batten, said method comprising the steps of:

forming a lower reinforcing sheet of substantially rigid low-density material including a plurality of lower reinforcing elements each element including contoured surface shapes defining moisture-passing channels;

cutting the lower reinforcing sheet into individual lower reinforcing elements;

providing a plurality of upper reinforcing elements;

introducing into each lower reinforcing element a low density closed cell foam material;

placing one upper reinforcing element of the plurality of upper reinforcing elements in overlying relationship to each individual lower reinforcing element containing the foam material and allowing the foam material to fill a space defined between each individual lower reinforcing element and the overlying upper reinforcing element to form a plurality of composite roof battens, each roof batten including contoured surface shapes defining moisture-passing channels.

12. The method according to claim 11 wherein the step of forming includes one of thermo-forming and molding the lower reinforcing sheet.

13. The method according to claim 11 wherein the step of forming a lower reinforcing sheet includes forming a sheet of acrylonitrile-butadine-styrene material.

14. The method according to claim 11 wherein the step of providing a plurality of upper reinforcing elements includes providing elements of acrylonitrile-butadine-styrene material.

15. The method according to claim 11 wherein the step of introducing includes introducing into each lower reinforcing element a solution including polyurethane.

16. The method according to claim 11 further including bonding the lower reinforcing element with the foam material and the foam material with the upper reinforcing element subsequent to the step of placing the upper reinforcing element.

17. The method according to claim 16 wherein the step of introducing includes introducing into the lower reinforcing element a solution that bonds with the lower and upper reinforcing elements.

* * * * *